United States Patent [19]

Sundholm

[11] Patent Number: 4,874,002

[45] Date of Patent: Oct. 17, 1989

[54] APPARATUS FOR FLUSHING A PIPING SYSTEM

[76] Inventor: Göran Sundholm, Helsingforsvägen 23 A, SF-02700 Grankulla, Finland

[21] Appl. No.: 34,557

[22] PCT Filed: Jul. 7, 1986

[86] PCT No.: PCT/FI86/00078

§ 371 Date: Feb. 26, 1987

§ 102(e) Date: Feb. 26, 1987

[87] PCT Pub. No.: WO87/00455

PCT Pub. Date: Jan. 29, 1987

[30] Foreign Application Priority Data

Jul. 22, 1985 [FI] Finland ..... 852846
Jan. 24, 1986 [FI] Finland ..... 860340

[51] Int. Cl.[4] ..... B08B 9/06

[52] U.S. Cl. ..... 134/111; 134/169 C; 137/240

[58] Field of Search ..... 134/111, 166 C, 169 A, 134/169 C, 169 R; 137/240

[56] References Cited

U.S. PATENT DOCUMENTS

| | | | |
|---|---|---|---|
| 2,835,261 | 5/1958 | Wogan | 134/111 |
| 3,072,503 | 1/1963 | Baum | 134/164 R |
| 3,182,670 | 5/1965 | Howell | 134/169 R |
| 4,119,110 | 10/1978 | Stone | 137/240 |
| 4,167,193 | 9/1979 | Magnus et al. | 134/169 A |
| 4,194,524 | 3/1980 | Wicke | 137/240 |
| 4,325,340 | 4/1982 | O'Neill | 123/447 |
| 4,485,840 | 12/1984 | Erwin | 137/240 |

*Primary Examiner*—Harvey C. Hornsby
*Assistant Examiner*—Corinne M. Reinckens
*Attorney, Agent, or Firm*—Ladas & Parry

[57] ABSTRACT

The present invention relates to a flushing apparatus for cleaning a piping system (2) internally. The object of the invention is to achieve efficient cleaning without the use of equipment heavily overdimensioned in relation to the nominal flow through the piping system. According to the invention, use is made of a pump (4) having an operational pressure essentially higher than the pressure fall of the piping system at a turbulent flow, in combination with at least one pressure liquid accumulator (21). The flushing circuit includes at least one blocking valve (15, 15*a*) which is opened upon reaching intended (maximal) pressure, thereby producing a powerful flow pulse through the piping system (2).

10 Claims, 2 Drawing Sheets

APPARATUS FOR FLUSHING A PIPING SYSTEM

Before regular operation, hydraulic and lubrication piping systems, for example, require internal cleaning for removing contaminating particles remaining after manufacture and assembly, which particles otherwise cause damage later during the regular operation. The cleaning is carried out by flushing, a thorough and time-consuming process. In order to achieve a satisfactory result, it is, according to the general opinion, necessary to carry out the flushing with a flow volume approximately double to the nominal flow volume of the piping system and, in addition, preferably at the same temperatures as during normal operation, in order to obtain a turbulent flow, Reynold's number about 3000. Of the flushing aggregate, mainly of its hydraulic pump, is thus required about the double flow capacity compared to what is required for the regular operation. For large piping system this demand leads to unreasonable high costs since the "over-dimensioned" flushing aggregate is used only once. For this reason, such piping systems have heretofore in most cases been inadequately flushed, with the result that impurities remained in the piping system, which later, but often very soon, have caused serious damage.

The object of the present invention is to provide a new apparatus enabling an efficient flushing of piping system at low costs.

The present invention thus relates to an apparatus for flushing a piping system, or a part thereof, comprising a hydraulic pump means and filter means.

The apparatus according to the present invention is mainly characterized in that the operational pressure of the pump means is essentially higher than what is required for overcoming the pressure fall of the piping system at nominal flow volume, that between the pump means and the pressure line of the piping system is connected at least one pressur liquid accumulator, and that the flushing circuit includes a blocking valve arranged to be intermittently opened in order to effect a powerful pulsating flow through the piping system.

The apparatus can be embodied as a complete flushing aggregate with a pump and a tank of its own. An alternative is to make use of the existing hydraulic liquid tank of the piping system and thus have an aggregate with a pump, pressure liquid accumulator(s) and filter means.

It is possible to further reduce mobile units with the benefit by making use of the same hydraulic aggregate which is intended for the regular operation of the piping system. The mobile units remaining are a pressure liquid accumulator unit and a filter unit which may be combined into one. These units may be connected by means of flexible hoses, between the hydraulic aggregate and the outline of the piping system as well as between the in-line of the piping system and the hydraulic aggregate, respectively. if there is a plurality of out- and/or in-lines they may either be coupled together or flushed separately. When flushing, the regular filter cartridge of the hydraulic aggregate is removed and replaced by a separate filter unit of larger capacity.

In the following the invention will be described more in detail, with reference to the attached drawing showing three embodiments in schematical diagram form.

Figure 1:
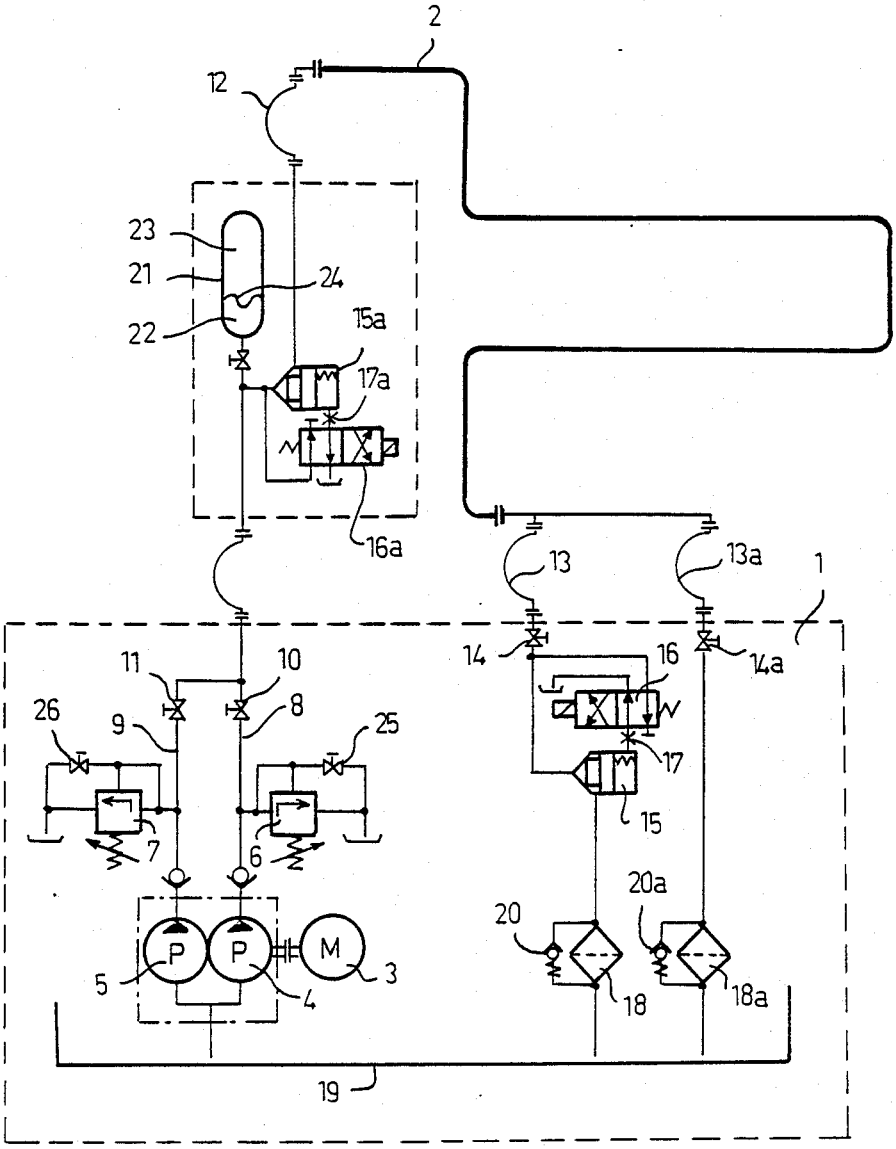
FIG. 1 shows an embodiment of a complete flushing aggregate.

In FIG. 1, reference numeral 1 indicates a basic unit of the apparatus. A piping system to be flushed is schematically indicated by the line 2.

The basic unit 1 of the aggregate has a drive motor 3 for two hydraulic pumps 4 and 5, each with a safety valve 6 and 7, respectively. The (pressure) out-lines of the pumps 4 and 5 are denoted 8 and 9, conventional shut-off valves are denoted 10 and 11. The out-line of the piping system 2 starts at a connection 12 and the (return) in-line of the piping system ends at a connection 13. 14 is a conventional shut-off valve, 15 and **15*a* indicate each valve either kept open or closed by means of a control vave 16 and 16*a* (through an intermediate valve 17, 17*a* for adjusting the speed (to open position) of the valve 16, 16*a*. 18 is a filter; when blocked the liquid is flowing to the tank 19 of the aggregate through a valve 20 in parallel with the filter 18**.

In connection with the out-lines 8 and 9 of the pumps 4 and 5 is arranged at least one pressure liquid accumulator 21, comprising a liquid space 22, a gas space 23 under a certain initial pressure, e.g. 10 bar, and a flexible membrane 24 separating these two spaces. Reference numerals **13*a*, 14*a*, 18*a* and 20*a* indicate a filter line in parallel with the filter line 13, 14, 18 and 20 but without a blocking valve similar to the one indicated 15**.

At nominal volume flow, the pressure fall in existing piping systems is typically about 10 bar. The pump 4 operates with an essentially higher pressure, e.g. 50 bar, but has a relatively low volume capacity, about 20% of the nominal flow (about 2000 liters per minute) of the piping system 2. Hydraulic pumps dimensioned such are available on the market at acceptable costs.

The operation of the flushing aggregate according to FIG. 1 is described in the following.

When the flushing operation is started, the control valve **16*a* is in the opposite position as the one shown in FIG. 1 and thus keeps the valve 15*a* closed through the influence of the pressure of the pumps 4 and 5. When the valve 15*a* is closed, the accumulator 21 is filled with liquid until the liquid pressure in the accumulator is the same as the operational pressure of the pumps 4 and 5, in this case about 50 bar. At this stage the valve 15*a* is opened whereupon the pressure liquid accumulator 21 is emptied, generally in one to two seconds, and a powerful liquid pulse flows through the piping system 2. The valve 14 is shut, i.e. the blocking valve 15 is not in the flow circuit, the flow passes through the filer 18*a*. After the accumulator is empty and the flow pulse has attenuated, the valve 15*a* is again closed and the pressure starts rising. The aggregate can be kept to operate in this way for any time necessary in order to flush the major part of the contamination from the piping system 2**.

After this first stage, the valve 14 is opened and the valve **14*a* is closed; the valve 15 is kept in open position. Except for that the valve 15 now has taken over the function of the valve 15*a*, the operation is in principle the same as earlier. By rapidly closing the valve 15 and thus suddenly interrupting the powerful flow pulse, a pressure peak of about three to four times the pressure of the pump 4 (i.e. up to about 200 bar), is produced within the piping system 2. The valve 15 can be arranged to open and close several times during each flow pulse. The pressure peak is adjustable by meas of the flow control valve 17. The valves 16, 16***a* may be solenoid operated valves actuated by adjustable timers. The time needed to reach a pressure of 50 bar can be determined with the help of the over-flow valve 6. If a pressure less than 50 bar is considered sufficient, the corresponding time to reach that pressure can be determined with the help of a manometer. The time for emptying the accumulator 21 can be determined by means of a manometer, in combination with the valves 17, 17*a* for adjusting the opening speed of the valves 15, 15*a*.

The timers (not shown in the drawing) of the valves 16, 16*a* are set according to the times so determined, whereafter the valves 16, 16*a* automatically open and shut the valves 15, 15*a* during the respective stages of flushing process. The duration of the process may greatly vary, from about one hour to about one week, depending on the dimension of the piping system and on required cleanness.

Piping systems here contemplated are often of a large volume, e.g. about 4000 liters. In the second stage just described, a considerable increase in the amount of liquid in the flushing pulse can be achieved. Existing pressure liquid accumulators usually have a volume of some 35 liters, whereof about 20 liters constitute the effective volume. By using three parallel accumulators, a liquid amount of about 60 liters is available for the powerful flushing pulse. Before the valve 15 is opened and the accumulators (21) are discharged, a pressure corresponding to the operational pressure of the pump 4 fills the whole piping system 2, said pressure being assumed to about 50 bar in this case. In spite of the fact that liquids generally are considered non-compressible they still are object to a certain compression, about one percent per 100 bar. If the volume of the piping system 2 is 4000 liters, this means an increase of liquid within the system of about 20 liters, which increase actively takes part in the flushing pulse, and in the embodiment of FIG. 1 constitutes one third of the volume of the pressure liquid accumulators.

In the following is presented an example of practical flow values for the flushing, on the basis of the aforementioned dimensions for the piping system 2, the pump 4 as well as the pressure accumulators (21). When the valve 15 is opened, the accumulators 18 are discharged at a pressure difference of about 40 bar, in a time of 1 to 2 seconds. Such accumulators give, typically, a flow of about 900 liters per minute, according to FIG. 1 together about 2700 liters per minute. In addition, due to the compression of the liquid inside the piping system 2, there is an addition of about 30%, i.e. about 900 liters per minute, and the flow of the pump 4, about 350 liters per minute. The overall pulse flow is thus about 4000 liters per minute. The pulse flow can further be increased e.g. by increasing the volume of the pressure liquid accumulators.

Although the arrangement of the blocking valve 15 after the piping system 2 brings about certain advantages, it should, however, be observed that a consequence of this arrangement is that the flushing liquid, with impurities, will flow through the blocking valve 12 and there remains a risk for the valve being eventually jammed. This is why the valve 15 was disconnected while removing a major part of the contaminations in the first stage as earlier described.

The idea of the pressure peaks reaching the nominal working pressure of the piping system 2 during the second stage of the flushing operation is to rapidly expand and contract the pipe walls of the piping system 2 in order to remove contamination particles of the size order about 1 to 25 microns "wedge" in the surface texture. Alternatively, the said nominal pressure can be achieved by using a separate pump, such as 5 in FIG. 1, in which case the valve 25 is opened in order to release the valve 6 and the pump 4.

Figure 2:
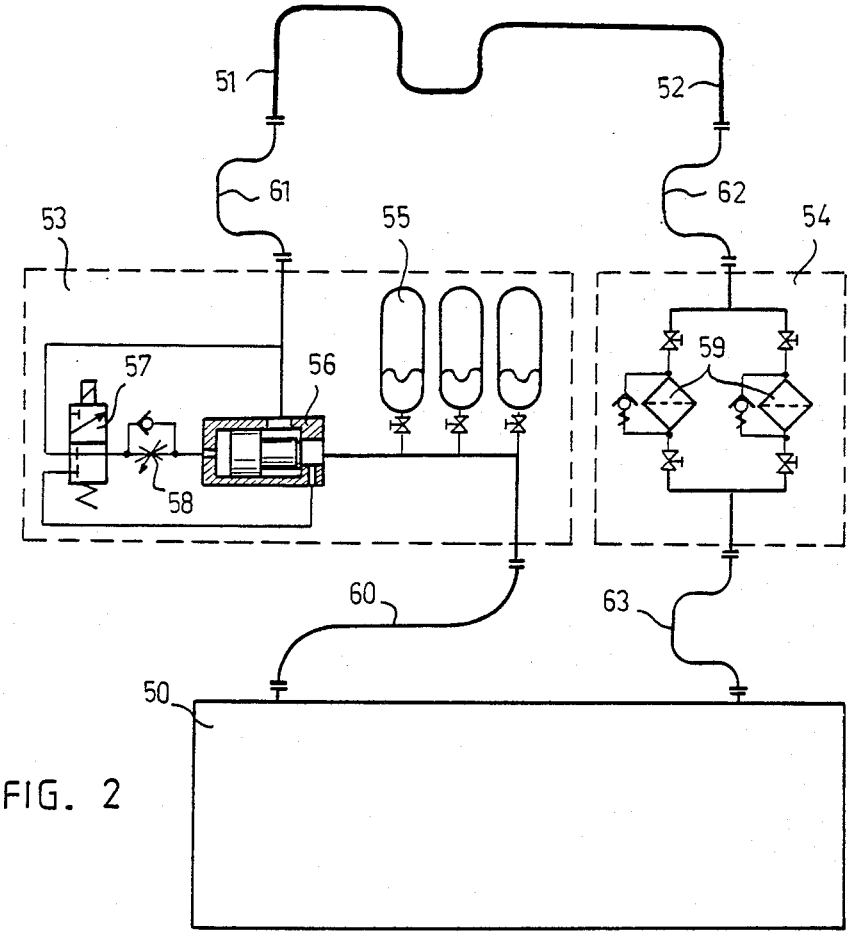
FIG. 2 shows an embodiment utilizing a hydraulic aggregate intended for the regular operation of the piping system.

The embodiment according to FIG. 2 is simplified in that it utilizes a hydraulic aggregate 50 provided for the regular operation of the piping system, here only schematically indicated by the line 51, 52. An advantage of the embodiment of FIG. 2 is that the mobile parts are restricted to a pressure liquid accumulator unit 53 (accumulator station) and to a filter unit 54.

The accumulator unit 53 includes three pressure liquid accumulators 55, each with a liquid space, a gas space under a certain initial pressure, and a flexible membrane separating these spaces, as in FIG. 1. 56 indicates a blocking valve kept open or closed by means of control valves 57 and 58, in the same manner as described for FIG. 1. The filter 54 includes two parallel filters 59 making a replacement possible without interrupting the flushing process. The hydraulic aggregate 50, the accumulator unit 53, the piping system 51, 52 and the filter unit 54 may be interconnected by means of flexible hoses (tubes) 60, 61, 62 and 63.

The operation of the embodiment of FIG. 2 is in principle all the same as for the embodiment of FIG. 1. Thus, an additional blocking valve, similar to valve 56, can be arranged before the filters 59. In principle the valve 15*a* of FIG. 1 and the valve 56 of FIG. 2 may be omitted if similar valves are provided before the filters.

Figure 3:
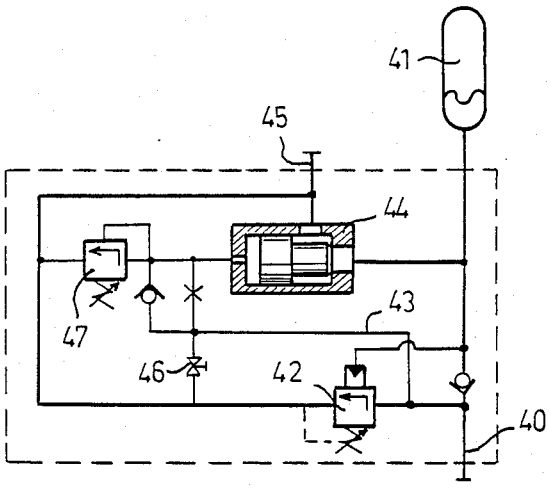
FIG. 3 shows an embodiment like the one of FIGS. 1 and 2, except for its control.

The embodiment of FIG. 3 works in principle in the same way as the embodiments of FIGS. 1 and 2, except for the control of the blocking valve. When the pressure rises in the pump pressure line 40, and in the pressure liquid accumulator 41, to the limit value of the valve 42, e.g. 50 bar, the valve 42 opens and the flow passes through the valve. Thereby the pressure drops in the line 43 causing the valve 44 to open and a flushing pulse flows to the pressure line 45 of the piping system as well as the pump flow. When the pressure of the accumulator 41 has droped, e.g. 30%, the valve 42 closes and the pressure starts rising again thereby also closing the blocking valve 44. The operation continues in this manner until the shut-off valve 46 is opened and the accumulation stops. Reference numeral 47 indicates a pilot pressure relief valve for the blocking valve 44 in order to safeguard the accumulator 41 against over-pressure.

In addition to initial flushing, the apparatus of the invention may, of course, as well be used for piping systems contaminated during regular operation.

I claim:

1. An apparatus for flushing a piping system, comprising:

liquid pump means (4, 50) for providing pressure liquid at an operational pressure higher than that to overcome a pressure fall of a piping system (2, 51) at a turbulent flow;

at least one pressure liquid accumulator (21, 41, 55) connected to the liqud pump means for receiving the pressure liquid therefrom, the pressure liquid accumulator comprising a liquid space having an inlet/discharge opening for receiving and discharging the pressure liquid into and out of the liquid space, a continuously closed gas space for a gas, and a flexible membrane between the liquid and closed gas spaces for compressing the gas in the closed gas space when the pressure liquid is received in the liquid space, whereby the pressure in the pressure liquid accumulator increases;

connection means for connecting the inlet/discharge opening to the piping system and providing the pressure liquid discharge out of the former to the latter;

at least one blocking valve means (15, 15*a*, 44, 56) for inhibiting the provision of the pressure liquid discharge to the piping system by the connection means until a predetermined pressure is reached in the pressure liquid accumulator and then suddenly opening for suddenly permitting the provision of the same, whereby to produce a powerful flow pulse through the piping system.

2. An apparatus according to claim 1, further comprising filter means in the piping system.

3. An apparatus according to claim 1, wherein the pump means is a liquid aggregate (50) provided for the regular operation of the piping system.

4. An apparatus according to claim 1, wherein a plurality of pressure liquid accumulators are coupled in parallel.

5. An apparatus according to claim 1, wherein a blocking valve means (15) is arranged after the piping system.

6. An apparatus according to claim 1, wherein a blocking valve means (15*a*, 44, 56) is arranged before the piping system.

7. An apparatus according to claim 1, wherein blocking valve means (15, 15*a*) are arranged both after and before the piping system.

8. An apparatus according to claim 5 or 7, wherein the blocking valve means (15) after the piping system (2) is arranged to rapidly interrupt the powerful flow pulse in order to produce a pressure peak within the piping system (2).

9. An apparatus according to claim 1 and 5 or 7, wherein the liquid pump means include an additional pump (5), connectable in parallel, of a pressure at least essentially corresponding to a nominal work pressure of the piping system (2).

10. An apparatus according to claim 7, wherein the blocking valve means (15) after the piping system (2) is arranged to rapidly interrupt the powerful flow pulse in order to produce a pressure peak within the piping system (2).

* * * * *